US008776571B2

(12) United States Patent
Pang

(10) Patent No.: US 8,776,571 B2
(45) Date of Patent: Jul. 15, 2014

(54) PLIERS

(71) Applicants: Haohui Pang, Foshan (CN); Zhaohui Shi, Zhuhai (CN)

(72) Inventor: Haohui Pang, Foshan (CN)

(73) Assignees: Haohui Pang, Foshan (CN); Zhaohui Shi, Zhuhai (CN)

( * ) Notice: Subject to any disclaimer, the term of this patent is extended or adjusted under 35 U.S.C. 154(b) by 0 days.

(21) Appl. No.: 14/059,474

(22) Filed: Oct. 22, 2013

(65) Prior Publication Data

US 2014/0076021 A1 Mar. 20, 2014

Related U.S. Application Data

(63) Continuation-in-part of application No. PCT/CN2012/000688, filed on May 18, 2012.

(30) Foreign Application Priority Data

Apr. 25, 2011 (CN) ..... 2011 1 0105732

(51) Int. Cl.
*B21D 9/08* (2006.01)

(52) U.S. Cl.
USPC ..... 72/409.18; 72/409.01; 72/409.19; 72/412; 72/415; 72/370.04

(58) Field of Classification Search
USPC ..... 72/370.04, 370.01, 407, 409.01, 72/409.08, 409.18, 409.19, 412, 415
See application file for complete search history.

(56) References Cited

U.S. PATENT DOCUMENTS

| | | | | |
|---|---|---|---|---|
| 2,347,390 | A * | 4/1944 | Baldwin | 72/409.18 |
| 2,828,780 | A * | 4/1958 | Gray | 72/409.01 |
| 3,170,345 | A * | 2/1965 | Poingt | 72/409.12 |
| 3,680,351 | A * | 8/1972 | Koshinen | 72/409.13 |
| 4,470,291 | A * | 9/1984 | Gibb et al. | 72/414 |
| 5,513,513 | A * | 5/1996 | Suess et al. | 72/409.18 |
| 6,269,674 | B1 * | 8/2001 | Sperko | 72/409.19 |
| 7,013,699 | B1 * | 3/2006 | Sperko | 72/409.19 |

* cited by examiner

*Primary Examiner* — David B Jones
(74) *Attorney, Agent, or Firm* — Matthias Scholl P.C.; Matthias Scholl

(57) ABSTRACT

A pair of pliers including an upper jaw, a lower jaw, two handles, and a pivot. The upper jaw and the lower jaw combine to form a gripping jaw capable of opening and closing. The upper jaw is in the shape of an inner arc, and the lower jaw is in the shape of an outer arc. The inner arc includes a concave hole, and the outer arc includes a convex member corresponding to the concave hole. The two handles are integrated with the upper jaw and the lower jaw, respectively, and fixed via the pivot to form a cross connection.

14 Claims, 3 Drawing Sheets

PLIERS

CROSS-REFERENCE TO RELATED APPLICATIONS

This application is a continuation-in-part of International Patent Application No. PCT/CN2012/000688 with an international filing date of May 18, 2012, designating the United States, now pending, and further claims priority benefits to Chinese Patent Application No. 201110105732.3 filed Apr. 25, 2011. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a pair of pliers.

2. Description of the Related Art

Typically, metal pipes are connected by using threaded connection and ring expansion connection, both of which require cutting the ends of the pipes, thereby weakening the strength of the ends of the pipes. For the benefit of the cutting, the pipes must be manufactured to have a thick wall, thus consuming a large amount of metal materials. Although the ring expansion connection has a low requirement on the wall thickness of the pipes, soldered side seams of thin-walled pipes are prone to crack in the process of ring expansion.

SUMMARY OF THE INVENTION

In view of the above-described problems, it is one objective of the invention to provide a pair of pliers that are light-weighted, cheap, portable, and convenient for operation. The pliers cause no destruction to pipe ends and to soldered side seams upon processing.

To achieve the above objective, in accordance with one embodiment of the invention, there is provided a pair of pliers comprising an upper jaw, a lower jaw, two handles, and a pivot. The upper jaw and the lower jaw combine to form a gripping jaw capable of opening and closing. The upper jaw is in the shape of an inner arc, and the lower jaw is in the shape of an outer arc. The inner arc comprises a concave hole, and the outer arc comprises a convex member corresponding to the concave hole. The two handles are integrated with the upper jaw and the lower jaw, respectively, and fixed via the pivot to form a cross connection.

Upon processing a pipe, the clamping jaw is first opened, and the lower jaw is inserted into one end of the pipe. The end of the pipe is tightly against the clamping jaw. The convex member of the lower jaw is outside of the pipe wall, and the concave hole of the upper jaw is inside the pipe wall. The two handles are clamped tightly, and thus the convex member of the lower jaw protrudes outwards, the concave hole presses downwards. Consequently, a boss protrudes from the pipe wall duo to the clamping of the pliers. Thereafter, the handles are loosened, the clamping jaw is open, and the lower jaw is taken out of the end of the pipe.

Advantages of the invention are summarized as follows. The pliers can work out a boss on the pipe wall quickly and cause no destruction to pipe ends and to soldered side seams upon. There is no need for the pipe to dispose a screw thread, thus the thickness of the pipe wall reduces, the material cost is saved, and the assembly is convenient and economic.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a pair of pliers are described below. It should be noted that the following examples are intended to describe and not to limit the invention.

Figure 1:
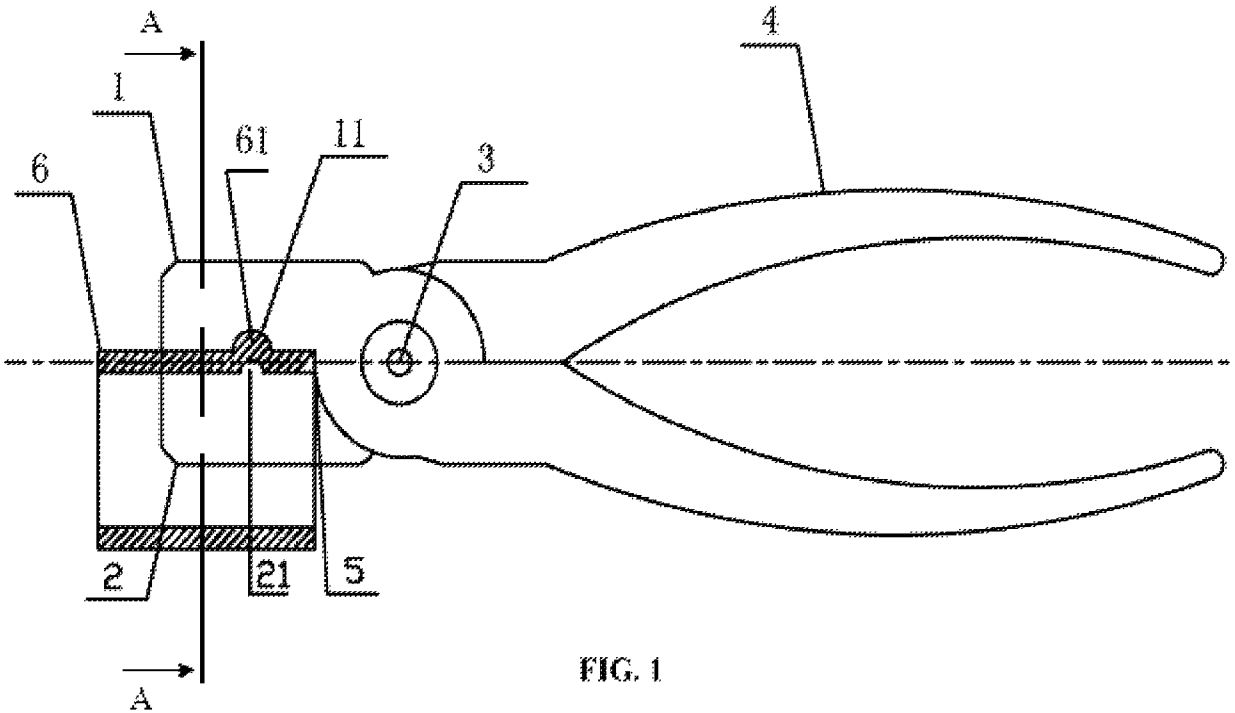
FIG. 1 is a schematic diagram of a pair of pliers of an exemplary embodiment of the invention upon processing a pipe to produce a boss.
Figure 2:
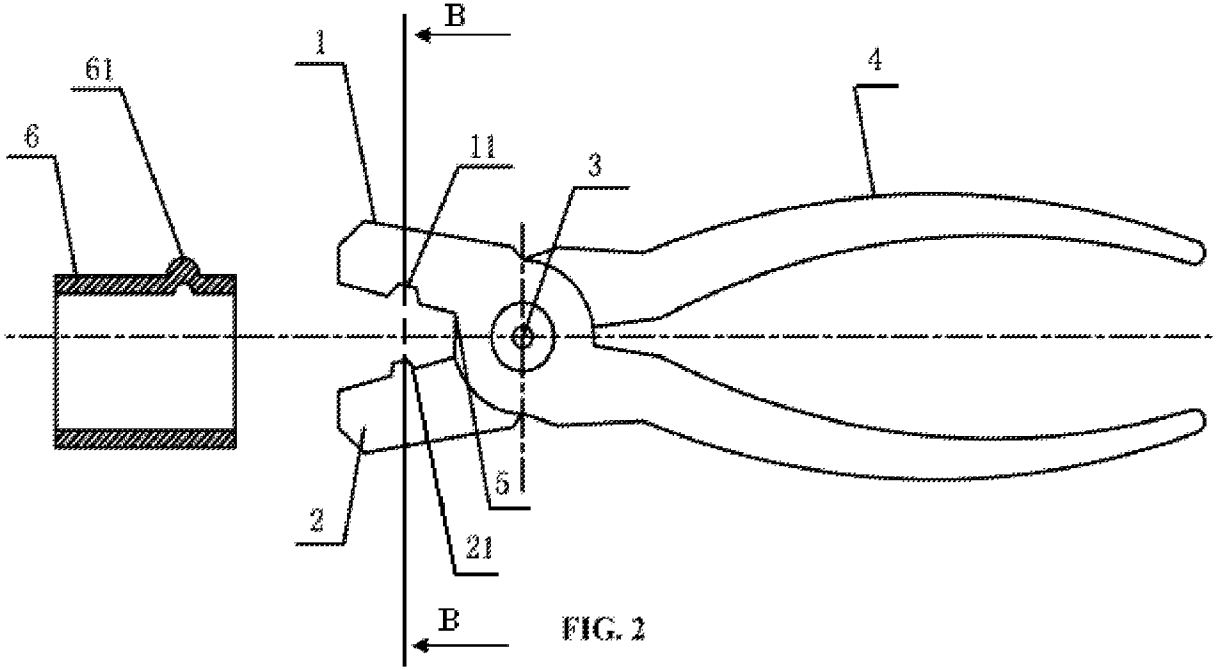
FIG. 2 is a schematic diagram of a pair of pliers of an exemplary embodiment of the invention after a boss is formed on a pipe.
Figure 3:
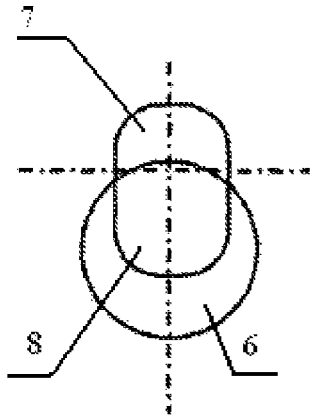
FIG. 3 is a cross section view along line A-A of FIG. 1.
Figure 4:
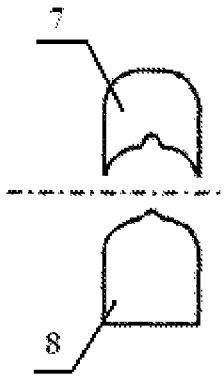
FIG. 4 is a cross section view along line B-B of FIG. 2.

As shown in FIGS. 1-2, a pair of pliers special for producing a boss on a thin-walled metal pipe comprises an upper jaw 1, a lower jaw 2, a pivot 3, and two handles 4. The upper jaw and the lower jaw combine to form a gripping jaw capable of opening and closing. The upper jaw is in the shape of a concave arc 7, and the lower jaw is in the shape of a convex arc 8. The inner arc comprises a concave hole 11, and the outer arc comprises a convex member 21 corresponding to the concave hole 11. The two handles are integrated with the upper jaw and the lower jaw, respectively, and fixed via the pivot to form a cross connection.

Upon processing a pipe 6, the lower jaw 2 is inserted into one end of the pipe 6. The end of the pipe is tightly against the bottom 5 of the clamping jaw. When the two handles 4 are clamped tightly, the upper jaw 1, the lower jaw 2, and the pipe 6 are combined. Thus, the convex member 21 of the lower jaw protrudes outwards, the concave hole 11 presses downwards, and the convex member is totally received by the concave hole 11. Consequently, a boss 61 protrudes from the pipe wall duo to the clamping of the pliers. Thereafter, the handles 4 are loosened, the clamping jaw is open, and the lower jaw 2 is taken out of the end of the pipe.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A pair of pliers, comprising:

a) a first jaw;

b) a second jaw;

c) two handles; and d) a pivot;

wherein:

the first jaw and the second jaw combine to form a gripping jaw capable of opening and closing;

the first jaw is in the shape of a concave arc, and the second jaw is in the shape of a convex arc matching the concave arc;

the first jaw comprises a concave hole, and the second jaw comprises a convex member corresponding to the concave hole; and the two handles are integrated with the first jaw and the second jaw, respectively, and fixed via the pivot to form a cross connection.

2. The pliers of claim 1, wherein a radius of the concave arc is greater than or equal to that of the convex arc.

3. The pliers of claim 1, wherein a radius of the concave hole is greater than that of the convex member.

4. The pliers of claim 1, wherein a radius of the concave arc is greater than that of the convex arc.

5. The pliers of claim 1, wherein the concave arc curves in a direction perpendicular to a longitudinal axis of the pliers and away from the second jaw, and the convex arc curves in a direction perpendicular to the longitudinal axis of the pliers and toward the first jaw.

6. The pliers of claim 1, wherein the concave arc extends from a front end of the first jaw to a position where the first jaw intersects with the second jaw.

7. The pliers of claim 1, wherein the convex arc extends from a front end of the second jaw to a position where the first jaw intersects with the second jaw.

8. A pair of pliers, comprising:

a) a first jaw having a first surface;

b) a second jaw having a second surface;

c) two handles; and d) a pivot;

wherein:

the first jaw and the second jaw combine to form a gripping jaw capable of opening and closing;

the first surface is of a concave shape, and the second surface is of a convex shape complementary to the concave shape;

the first jaw comprises a concave hole, and the second jaw comprises a convex member corresponding to the concave hole; and the two handles are integrated with the first jaw and the second jaw, respectively, and fixed to each other via the pivot to form a cross connection.

9. The pliers of claim 8, wherein a radius of the concave hole is greater than that of the convex member.

10. The pliers of claim 8, wherein the first surface is curved inward relative to a side surface of the first jaw.

11. The pliers of claim 8, wherein the second surface is curved outward relative to a side surface of the second jaw.

12. The pliers of claim 8, wherein the first surface is curved inwardly in a direction away from the second jaw, and the second surface is curved outwardly in a direction toward the first jaw.

13. The pliers of claim 8, wherein the second surface is curved outwardly in a direction toward the first jaw, and the first surface is curved inwardly in the same direction as that of the second surface.

14. The pliers of claim 8, wherein the first surface curves in a direction perpendicular to a longitudinal axis of the pliers, and the second surface curves in a direction perpendicular to the longitudinal axis of the pliers.

* * * * *